US008172697B2

(12) United States Patent
Cackett et al.

(10) Patent No.: US 8,172,697 B2
(45) Date of Patent: May 8, 2012

(54) SELECTIVELY LIGHTENED WOOD-TYPE GOLF CLUB HEAD

(75) Inventors: Matthew T. Cackett, San Diego, CA (US); Brandon T. Vincent, Tega Cay, SC (US); Alan Hocknell, Carlsbad, CA (US); Jeff Colton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 129 days.

(21) Appl. No.: 12/857,344

(22) Filed: Aug. 16, 2010

(65) Prior Publication Data

US 2011/0039636 A1 Feb. 17, 2011

Related U.S. Application Data

(60) Provisional application No. 61/234,384, filed on Aug. 17, 2009.

(51) Int. Cl.
*A63B 53/04* (2006.01)

(52) U.S. Cl. ..... 473/329; 473/345; 473/346; 473/349

(58) Field of Classification Search ..... 473/324–350, 473/287–292

See application file for complete search history.

(56) References Cited

U.S. PATENT DOCUMENTS

| | | | | |
|---|---|---|---|---|
| 1,167,387 | A | | 1/1916 | Daniel |
| 1,780,625 | A | | 4/1924 | Mattern |
| 1,638,916 | A | | 6/1926 | Butchart |
| 2,750,194 | A | | 1/1955 | Clark |
| 3,692,306 | A | | 9/1972 | Glover |
| 3,897,066 | A | | 7/1975 | Belmont |
| 3,937,474 | A | | 2/1976 | Jepson et al. |
| 3,975,023 | A | | 8/1976 | Inamori |
| 3,989,248 | A | | 11/1976 | Campau |
| 4,021,047 | A | | 5/1977 | Mader |
| 4,398,965 | A | | 8/1983 | Campau |
| 4,568,088 | A | | 2/1986 | Kurahashi |
| 4,872,685 | A | | 10/1989 | Sun |
| 4,877,249 | A | | 10/1989 | Thompson |
| 5,106,094 | A | | 4/1992 | Debiolles et al. |
| 5,193,811 | A | | 3/1993 | Okumoto et al. |
| 5,282,624 | A | | 2/1994 | Viste |
| 5,310,185 | A | | 5/1994 | Viollaz et al. |
| 5,344,140 | A | | 9/1994 | Anderson |
| 5,346,216 | A | | 9/1994 | Aizawa |
| 5,377,986 | A | | 1/1995 | Viollaz et al. |
| 5,398,935 | A | | 3/1995 | Katayama |
| 5,410,798 | A | | 5/1995 | Lo |
| 5,425,538 | A | | 6/1995 | Vincent et al. |
| 5,499,814 | A | | 3/1996 | Lu |
| 5,516,107 | A | | 5/1996 | Okumoto et al. |
| 5,547,427 | A | | 8/1996 | Rigal et al. |
| 5,570,886 | A | | 11/1996 | Rigal et al. |
| 5,624,331 | A | | 4/1997 | Lo et al. |
| 5,637,045 | A | | 6/1997 | Igarashi |
| 5,681,227 | A | * | 10/1997 | Sayrizi ..... 473/327 |
| 5,718,641 | A | * | 2/1998 | Lin ..... 473/224 |
| 5,743,813 | A | | 4/1998 | Chen et al. |

(Continued)

*Primary Examiner* — Sebastiano Passaniti

(74) *Attorney, Agent, or Firm* — Michael A. Catania; Rebecca Hanovice; Sonia Lari

(57) ABSTRACT

A wood type golf club head having a plurality of interior recesses is disclosed herein. The plurality of interior recesses are preferably formed in a body of the golf club head and remove mass from the body to be used elsewhere on the golf club head to increase the inertial properties of the golf club head.

4 Claims, 6 Drawing Sheets

U.S. PATENT DOCUMENTS 5,776,011 A 7/1998 Su et al.
5,863,261 A 1/1999 Eggiman
5,921,872 A * 7/1999 Kobayashi ..... 473/345
5,967,904 A 10/1999 Nagai et al.
5,979,855 A 11/1999 Maier
5,997,415 A * 12/1999 Wood ..... 473/346
6,071,200 A 6/2000 Song
6,146,571 A 11/2000 Vincent et al.
6,149,534 A * 11/2000 Peters et al. ..... 473/345
6,162,130 A 12/2000 Masumoto et al.
6,238,301 B1 5/2001 Takeda
6,334,817 B1 1/2002 Ezawa et al.
6,354,962 B1 3/2002 Galloway et al.
6,471,604 B2 * 10/2002 Hocknell et al. ..... 473/334
6,491,592 B2 12/2002 Cackett et al.
6,575,845 B2 6/2003 Galloway et al.
6,595,871 B2 * 7/2003 Sano ..... 473/342
6,645,086 B1 11/2003 Chen
6,648,773 B1 11/2003 Evans
6,663,504 B2 12/2003 Hocknell et al.
6,669,577 B1 12/2003 Hocknell et al.
6,719,643 B1 4/2004 Helmstetter et al.
6,783,465 B2 * 8/2004 Matsunaga ..... 473/329
6,785,126 B2 8/2004 Hazzard et al.
6,800,040 B2 10/2004 Galloway et al.
6,875,129 B2 4/2005 Erickson et al.
6,880,222 B2 * 4/2005 Matsunaga ..... 29/428
6,881,159 B2 4/2005 Galloway et al.
6,890,270 B2 5/2005 Ciasullo
6,902,497 B2 6/2005 Deshmukh et al.
6,926,616 B1 8/2005 Kusumoto et al.
6,932,716 B2 8/2005 Ehlers et al.
6,945,877 B2 9/2005 Kobayashi et al.
6,949,031 B2 9/2005 Imamoto et al.
6,964,617 B2 11/2005 Williams
7,066,835 B2 * 6/2006 Evans et al. ..... 473/346
7,108,612 B2 * 9/2006 Nakahara et al. ..... 473/329
7,108,614 B2 * 9/2006 Lo ..... 473/345
7,247,103 B2 * 7/2007 Beach et al. ..... 473/324
7,250,007 B2 * 7/2007 Lu ..... 473/329
7,258,624 B2 * 8/2007 Kobayashi ..... 473/324
7,448,964 B2 * 11/2008 Schweigert et al. ..... 473/345
7,510,485 B2 * 3/2009 Yamamoto ..... 473/345
7,632,193 B2 * 12/2009 Thielen ..... 473/334
2002/0019265 A1 * 2/2002 Allen ..... 473/329
2004/0192468 A1 * 9/2004 Onoda et al. ..... 473/345
2005/0143189 A1 * 6/2005 Lai et al. ..... 473/335
2008/0045356 A1 * 2/2008 Lin et al. ..... 473/346

* cited by examiner

SELECTIVELY LIGHTENED WOOD-TYPE GOLF CLUB HEAD

CROSS REFERENCES TO RELATED APPLICATIONS

The Present Application claims priority upon U.S. Provisional Application No. 61/234,384 filed on Aug. 17, 2009.

STATEMENT REGARDING FEDERALLY SPONSORED RESEARCH OR DEVELOPMENT

Not Applicable

BACKGROUND OF THE INVENTION

1. Field of the Invention

The present invention relates to a wood-type golf club head. More specifically, the present invention relates to a wood-type golf club head with components that have been selectively lightened to reduce mass of the components.

2. Description of the Related Art

The prior art discloses various golf club heads.

Existing wood designs, particularly drivers, generally seek to achieve a reduced structural weight fraction in the shell portion (i.e., sole, crown, ribbon) of the head so additional weight can be available for other design aspects (weighting, styling, etc). Reduced thickness can be achieved by forming and welding high strength titanium sheet stock, but it's difficult to locally and purposefully vary thickness to minimize weight using this construction. Local and purposeful thickness variation is readily achieved using the casting method of construction, but cast titanium is generally lower strength and requires increased overall shell thickness for adequate durability.

Further, the shell portion of the head significantly influences the sound (when struck by a ball). The formed sheet construction method is very limited in affecting sound since features such as local thickening and local webbing (which would influence sound) are not practical with this construction. Such features are readily added to shells made using cast construction, but again, minimum weight is difficult to achieve with this method.

Current wood heads struggle to achieve both minimum structural weight and pleasing sound at impact.

BRIEF SUMMARY OF THE INVENTION

The present invention provides a solution to the problem.

The present invention seeks to achieve a reduced structural weight fraction while also providing a means for affecting sound radiating from the sole and/or crown portions of the shell.

The present invention preferably includes of the introduction of a plurality of small diameter partial holes to the inside surface (IML) of a shell constructed using the sheet formed/welded construction. The holes are partial in that they originate on the IML surface and proceed into, but not thru the thickness of the shell. In other words, these are not "thru-holes." Being non-thru holes avoids adding complexity to finishing (polishing, painting, etc) of the exterior surface. Also, placing the holes on the interior surface avoids a likely undesirable cosmetic appearance. Also, use of non-thru holes avoids the need to seal the holes for prevention of moisture ingression.

The holes may be patterned in such a manner as to uniformly or locally reduce the effective density of the shell for purposes of achieving minimum structural weight fraction for the shell.

Further, the holes may be patterned in such a way as to uniformly or locally affect the stiffness/mass ration ($\sqrt{(k/m)}$ which in turn affects the resonant frequency and sound during impact.

A wood head having a body fabricated using formed sheets of metal which are subsequently welded together. Sole and/or crown and/or ribbon portions of the body contain a plurality on non-thru holes originating from the interior surface of the body.

The wood-type golf club head also preferably includes non-thru holes have a diameter between 0.030" and 10 microns. The wood-type golf club head also preferably includes non-thru holes penetrate between 50-90% of the local thickness of the shell. The wood-type golf club head also preferably includes non-thru holes are spaced in a pattern such that between 5/25% of the weight of the shell is removed. The wood-type golf club head also preferably includes the method of manufacture of the holes may include drilling, milling, punching, forming, forging, chemical etching, photo etching, water jet and laser.

The wood-type golf club head also preferably includes a secondary machining operation is required to re-flatten the side of the sheet w/o holes (ie fly cut). The wood-type golf club head also preferably includes the non-thru holes are applied to the sheet material in the flat state prior to forming in the general shape of the shell.

A pattern of holes are applied to the interior surface of the crown and/or sole portion of the head. The holes are non-thru holes and are not noticeable from the exterior surface of the head. The holes may be located and patterned (spaced) such that they result in reduced shell weight such that they positively affect the resonant response of the shell during impact and thus affect sound.

A wood with a selectively lightened shell by means of addition of a plurality of non-thru holes added to the interior surface of the body for purpose of weight reduction and/or sound refinement.

A driver head having a body fabricated using formed sheets of titanium which are subsequently welded together. Sole and/or crown and/or ribbon portions of the body contain a plurality of non-thru holes originating from the interior surface of the body.

Preformed construction is formed/molded sheet i.e., "multi-piece" construction.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
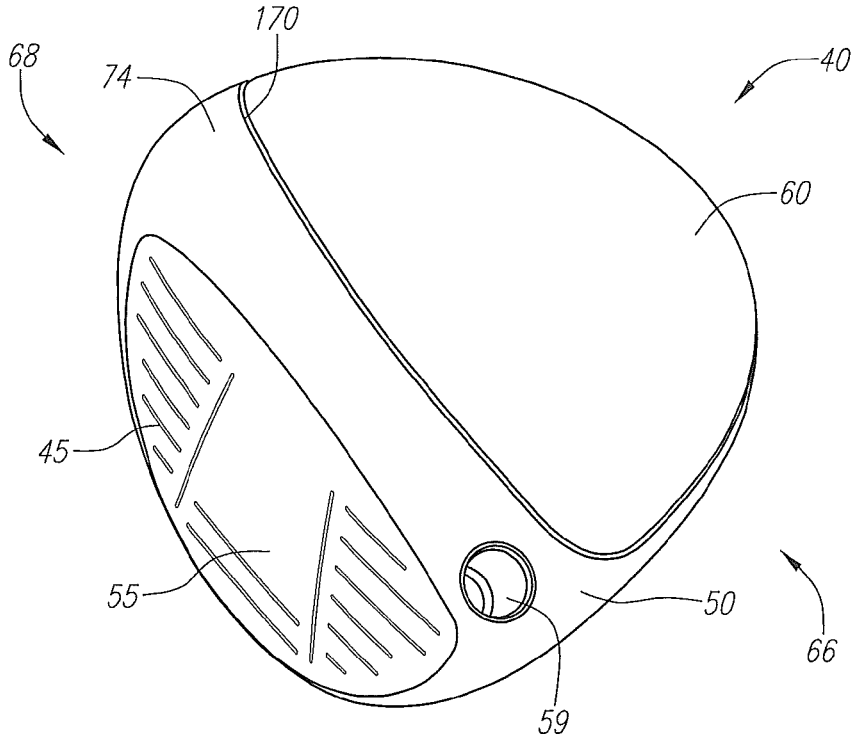
FIG. 1 is a top perspective view of a golf club head.
Figure 2:
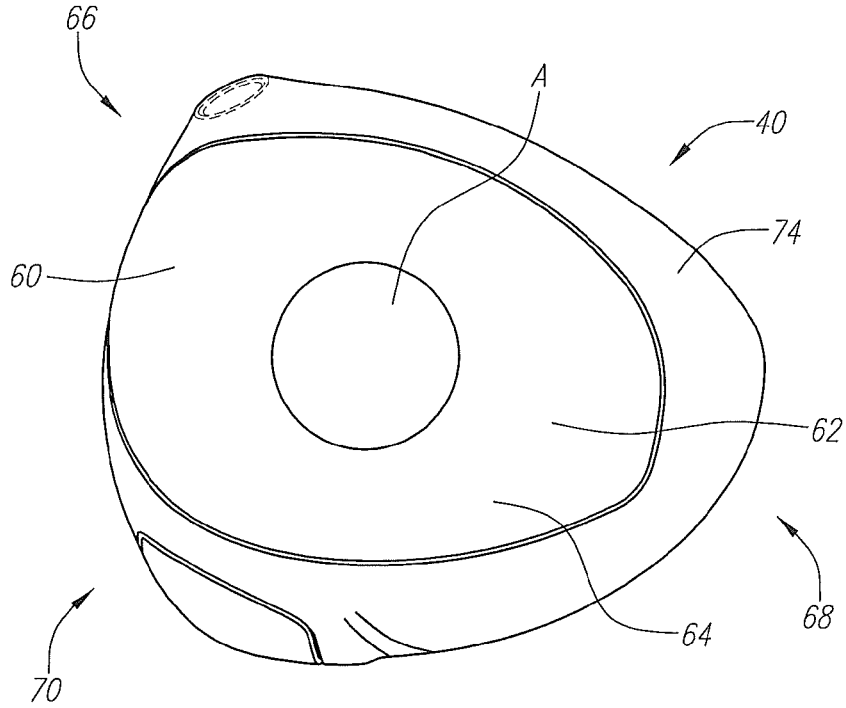
FIG. 2 is a rear top perspective view of the golf club head of FIG. 1.
Figure 2A:
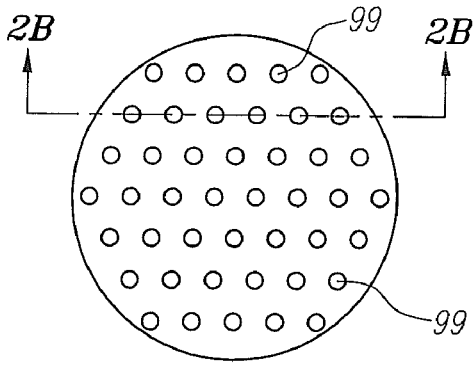
FIG. 2A is an isolated view of circle A of FIG. 2.
Figure 2B:
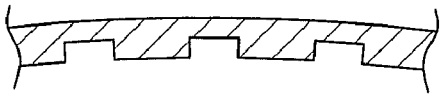
FIG. 2B is an isolated cross-sectional view of line B-B of FIG. 2A.
Figure 4A:
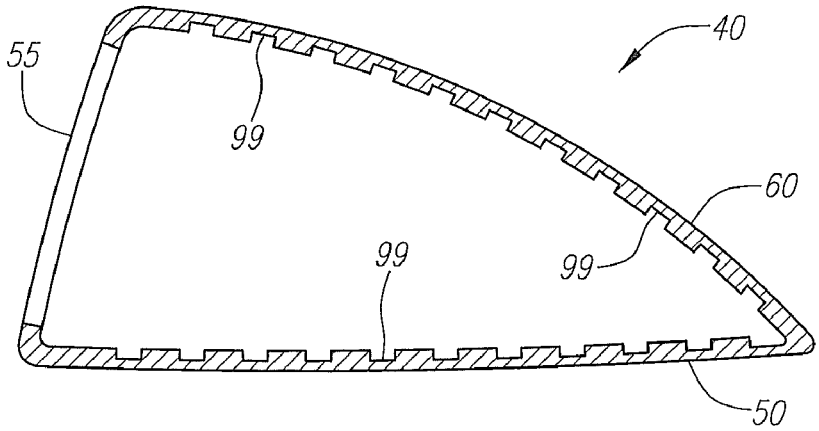
FIG. 4A is a cross-sectional view of the golf club head along line A-A of FIG.4.
Figure 3:
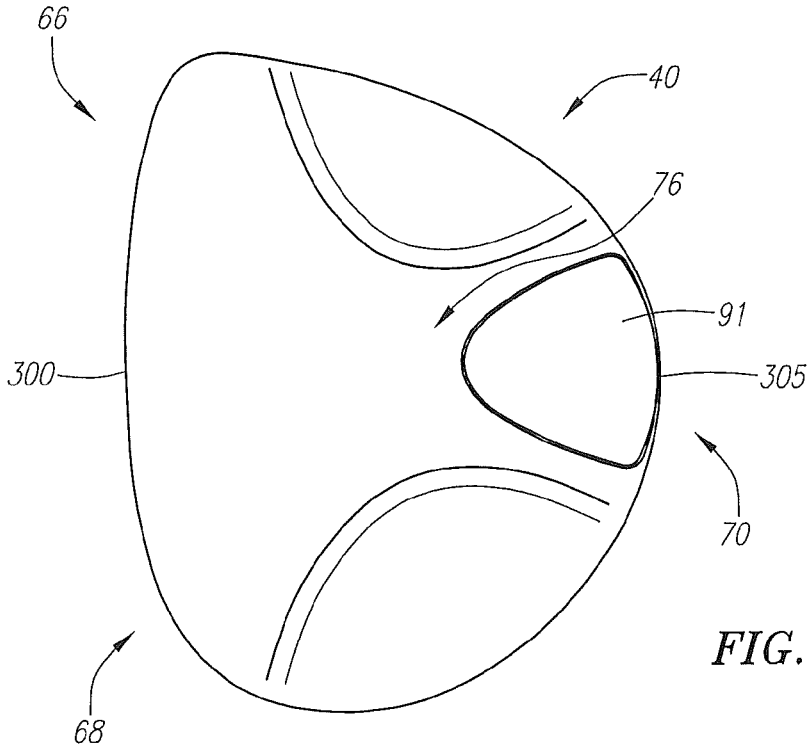
FIG. 3 is bottom plan view of the golf club head of FIG. 1.
Figure 4:
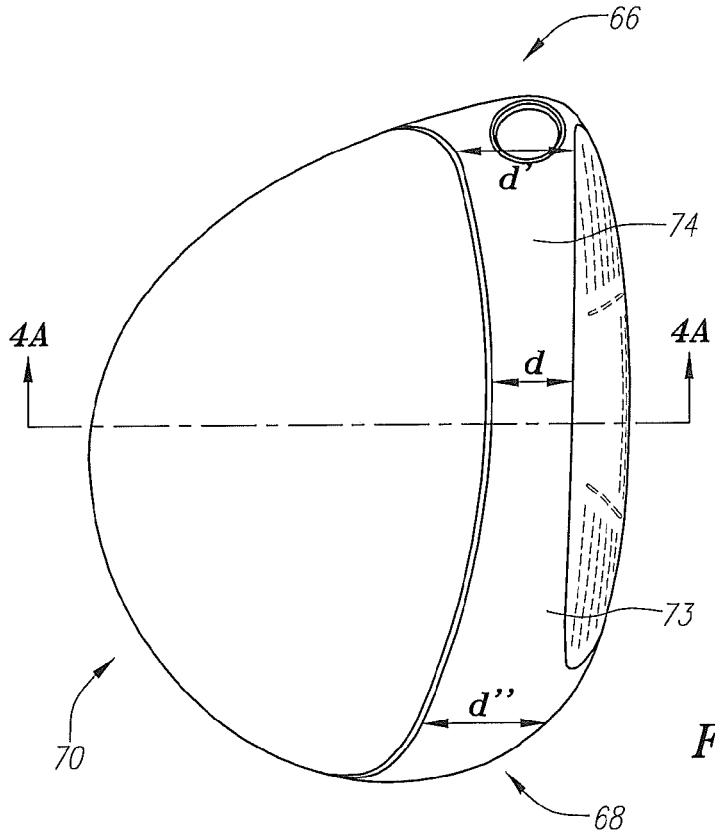
FIG. 4 is a top plan view of the golf club head of FIG. 1.
Figure 5:
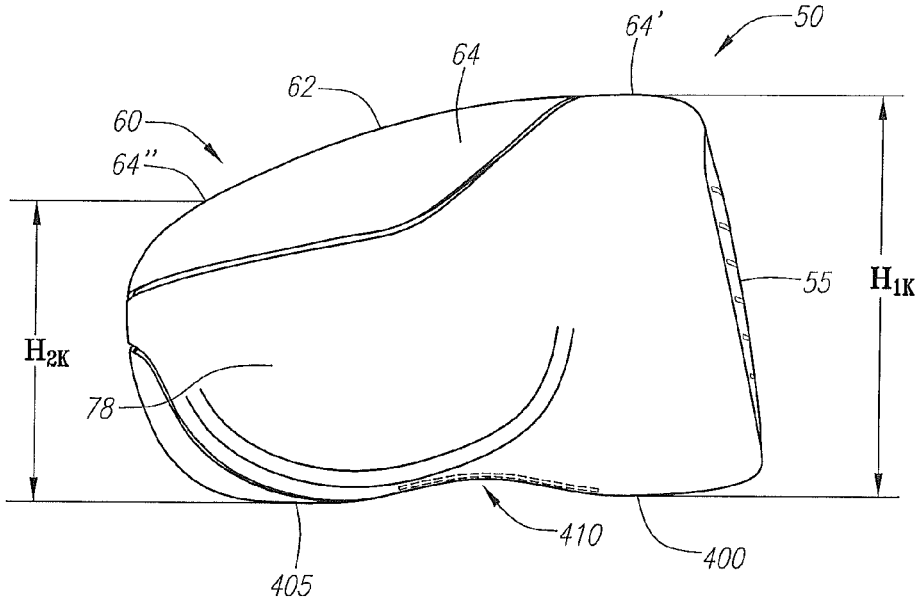
FIG. 5 is a toe side view of the golf club head of FIG. 1.
Figure 6:
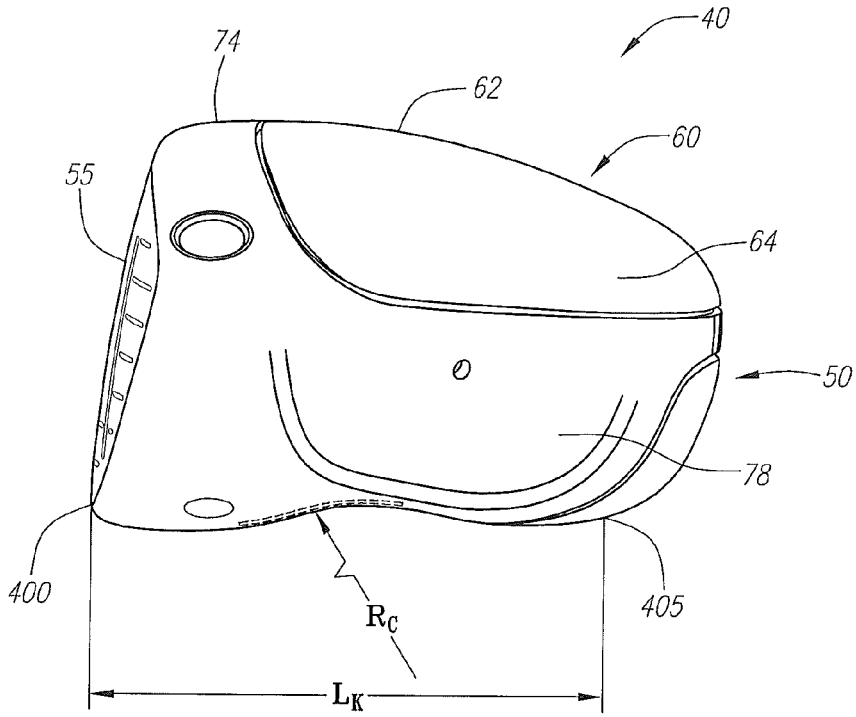
FIG. 6 is a heel side view of the golf club head of FIG. 1.
Figure 7:
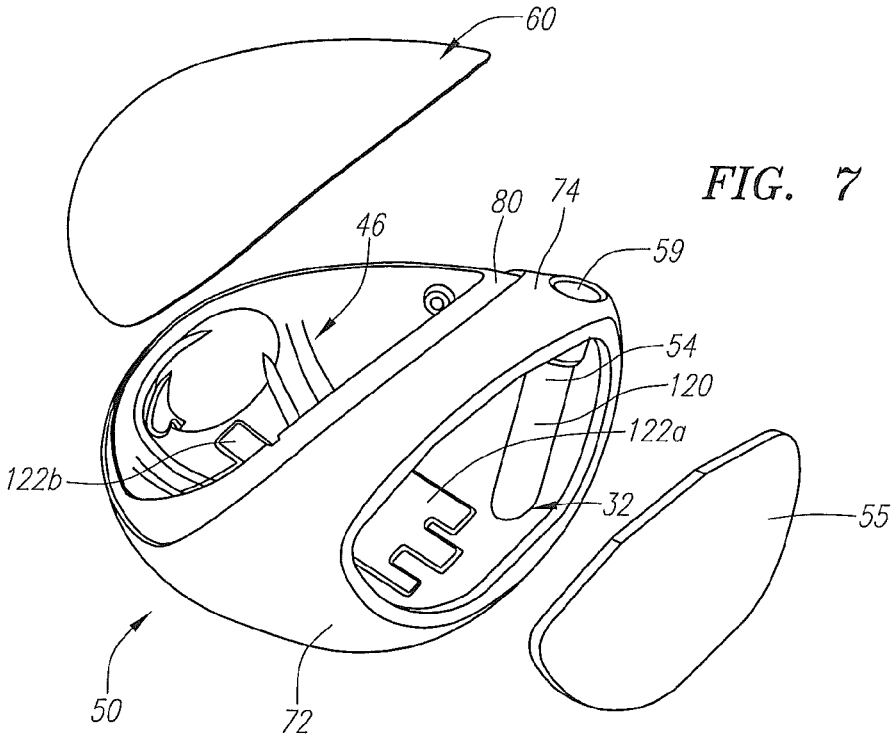
FIG. 7 is an exploded top perspective view of the golf club head.
Figure 8:
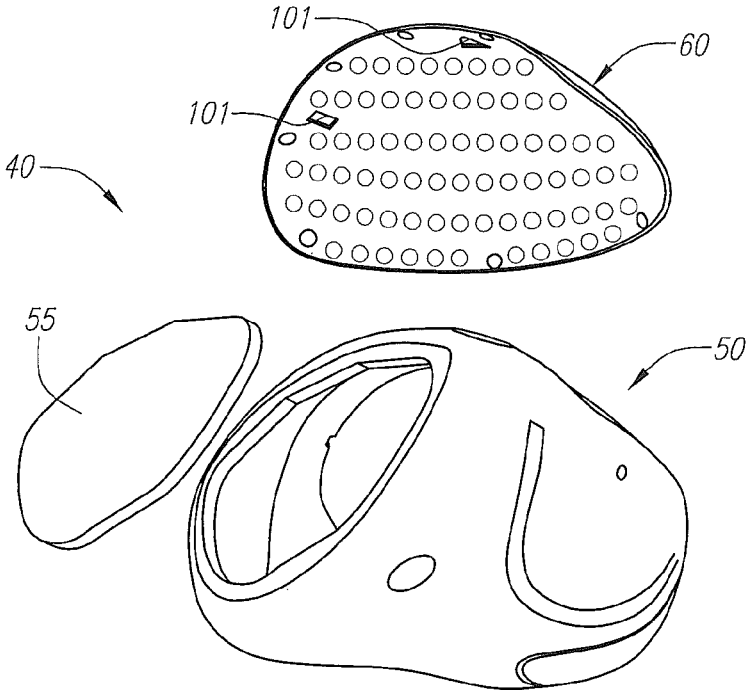
FIG. 8 is an exploded bottom perspective view of the golf club head.

As shown in FIGS. 1-10, in a preferred embodiment, a golf club head 40 is generally composed of three primary components, a major body 50, a striking plate insert 55 and minor body 60. The minor body 60 has a crown section 62 and a ribbon section 64. The club head 40 may also be partitioned into a heel end 66 nearest the shaft 48, a toe end 68 opposite the heel section 66, and an aft end 70. As shown in FIGS. 2A, 2B and 4A, the golf club head 40 has a plurality of interior recesses 99 in the major body 50 and the minor body 60. The plurality of interior recesses 99 reduce the mass of the golf club head 40 while maintaining the structural integrity of the golf club head 40. Each of the plurality of recesses 99 preferably has a depth ranging from 50% to 90% of the thickness of the major body 50 and the minor body 60. Each of the plurality of recesses 99 preferably has a diameter ranging from 0.030 inch to 10 microns.

The major body 50 is generally composed of a single piece of metal, and is preferably composed of a cast metal material. More preferably, the cast metal material is a stainless steel material or a titanium material such as pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Alternatively, the major body may be manufactured through forging, welding, forming, machining, powdered metal forming, metal-injection-molding, electro-chemical milling, and the like.

The major body 50 generally includes a front wall section 72, a return section 74 extending laterally rearward from the upper perimeter of the front wall section 72, a sole section 76 extending laterally rearward from the front wall section 72, a ribbon section 78 extending upward from the sole section 76, and a ledge section 80 stepped inward for attachment of the minor body 60. The front wall section 72 has an opening for placement of the striking plate insert 55 therein.

The return section 74 extends inward, towards the minor body 60, and has a general curvature from the heel end 66 to the toe end 68. The return section 74 has a length from the perimeter 73 of the front wall section 72 that is preferably a minimal length near the center of the front wall section 72, and increases toward the toe end 68 and the heel end 66. A distance d represents the length of the return section 74 from the perimeter 73 at the center of the front wall section 72, a distance d' from the perimeter 73 at the heel end 66 of the front wall section 72, and a distance d" from the perimeter 73 at the toe end 68 of the front wall section 72. In a preferred embodiment, the distance d ranges from 0.2 inch to 1.5 inches, more preferably 0.30 inch to 1.25 inches, and most preferably from 0.60 inch to 1.0 inch, as measured from the perimeter 73 of the front wall section 72 to the rearward edge of the return section 74. In a preferred embodiment, the distance d' ranges from 0.4 inch to 2.00 inches, more preferably 0.50 inch to 1.75 inches, and most preferably from 0.8 inch to 1.50 inches, as measured from the perimeter 73 of the front wall section 72 to the rearward edge of the return section 74. In a preferred embodiment, the distance d" ranges from 0.4 inch to 2.25 inches, more preferably 0.50 inch to 2.00 inches, and most preferably from 0.9 inch to 1.50 inches, as measured from the perimeter 73 of the front wall section 72 to the rearward edge of the return section 74.

The perimeter 73 of the front wall section 72 is defined as the transition point where the major body 50 transitions from a plane substantially parallel to the front wall section 72 to a plane substantially perpendicular to the front wall section 72. Alternatively, one method for determining the transition point is to take a plane parallel to the front wall section 72 and a plane perpendicular to the front wall section 72, and then take a plane at an angle of forty-five degrees to the parallel plane and the perpendicular plane. Where the forty-five degrees plane contacts the major body 50 is the transition point thereby defining the perimeter 73 of the front wall section 72.

The golf club head 40 has striking plate insert 55 that is attached to the major body 50 over the opening 32 of the front wall 72. The striking plate insert 55 is preferably composed of a formed titanium alloy material. Such titanium materials include titanium alloys such as 6-22-22 titanium alloy and Ti 10-2-3 alloy, Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. The preferred material for the striking plate insert 55 is a heat treated 6-22-22 titanium alloy which is a titanium alloy composed by weight of titanium, 6% aluminum, 2% tin, 2% chromium, 2% molybdenum, 2% zirconium and 0.23% silicon. The titanium alloy will have an alpha phase in excess of 40% of the overall microstructure. As shown in FIG.1, the striking plate insert 55 typically has a plurality of scorelines 45 thereon.

As shown in FIG. 1, the striking plate insert 55 is preferably welded to the front wall section 72 of the major body 50, thereby covering the opening 32. A plurality of tabs, not shown, preferably three, align the striking plate insert 55 for the welding process. Alternatively, the striking plate insert 55 is press-fitted into the opening 32.

The minor body 60 is preferably composed of a low density material, preferably a metal or a polymer material. Preferably metals include magnesium alloys, aluminum alloys, magnesium or aluminum material. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). If metal, the minor body 60 is preferably manufactured through metal-injection-molding, casting, forming, machining, powdered metal forming, electro chemical milling, and the like.

The mass of the club head 40 of the present invention ranges from 165 grams to 250 grams, preferably ranges from 175 grams to 230 grams, and most preferably from 190 grams to 205 grams. Preferably, the major body 50 has a mass ranging from 140 grams to 200 grams, more preferably ranging from 150 grams to 180 grams, yet more preferably from 155 grams to 166 grams, and most preferably 161 grams. The minor body 60 has a mass preferably ranging from 4 grams to 20 grams, more preferably from 5 grams to 15 grams, and most preferably 7 grams. Each stiffening member 122 has a mass preferably ranging from 1 gram to 50 grams, more preferably from 5 grams to 25 grams, and most preferably 10 grams. Additionally, epoxy, or other like flowable materials, in an amount ranging from 0.5 grams to 5 grams, may be injected into the hollow interior 46 of the golf club head 40 for selective weighting thereof. The golf club head preferably has a coefficient of restitution a ("COR") ranging from 0.81 to 0.875, and more preferably from 0.82 to 0.84. The golf club head preferably has a characteristic time ("CT") as measured under USGA conditions of 256 microseconds.

The golf club head 40 preferably has that ranges from 290 cubic centimeters to 600 cubic centimeters, and more preferably ranges from 330 cubic centimeters to 510 cubic centimeters, even more preferably 350 cubic centimeters to 495 cubic centimeters, and most preferably 415 cubic centimeters or 460 cubic centimeters.

Figure 9:
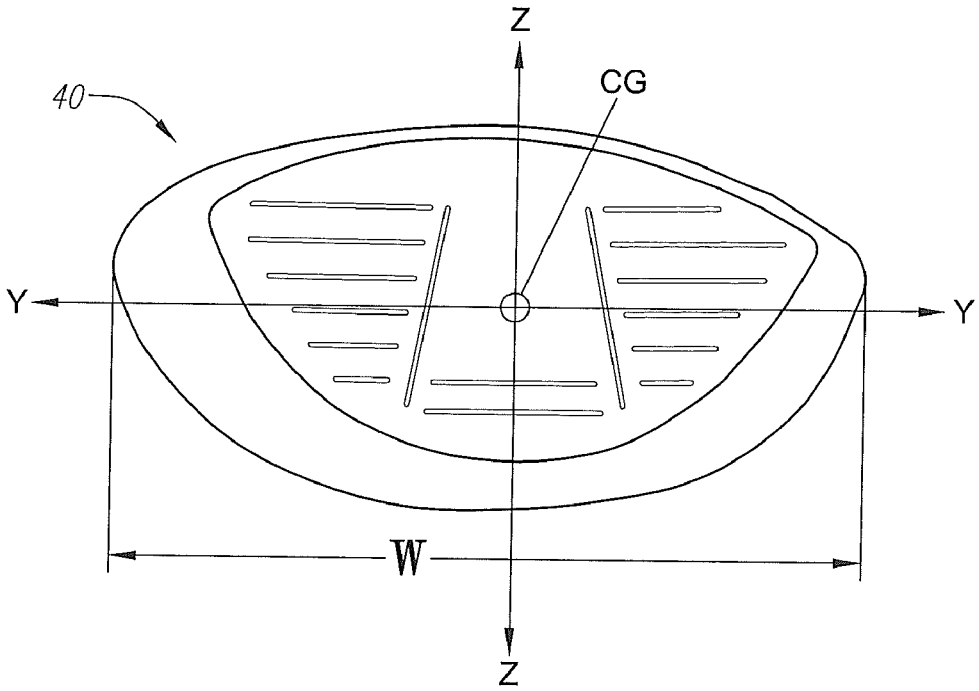
FIG. 9 is a front plan view of a golf club head illustrating the Z axis and Y axis through a center of gravity of the golf club head, and also the width of the golf club head.
Figure 10:
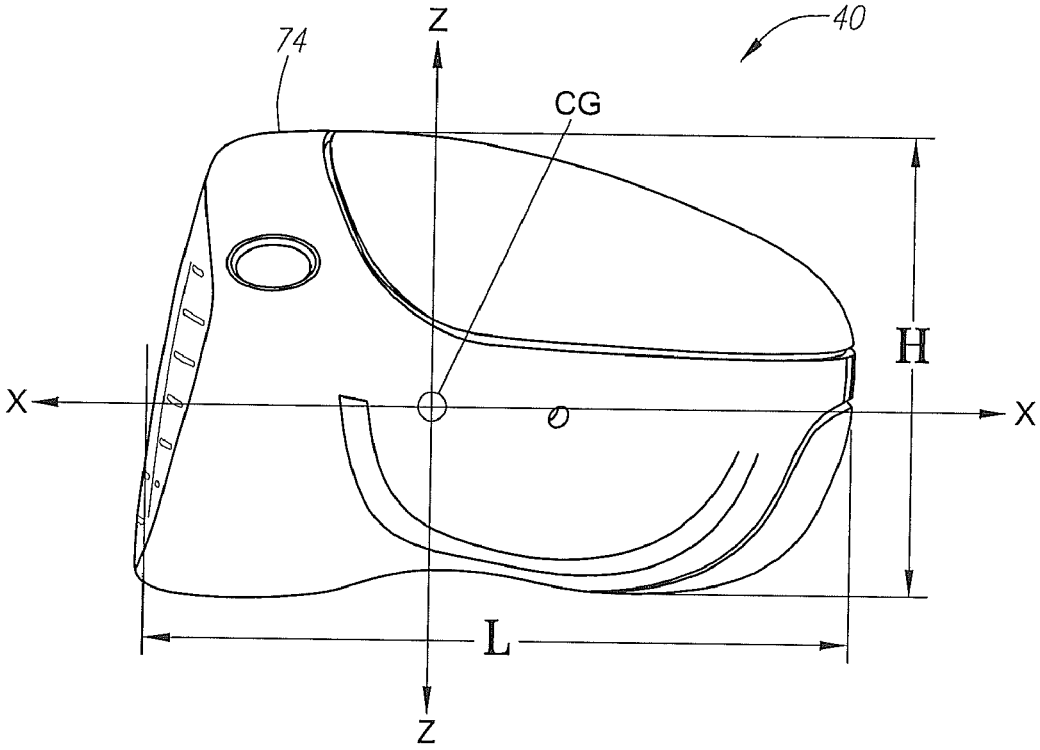
FIG. 10 is a heel side view of a golf club head illustrating the Z axis and X axis through a center of gravity of the golf club head, and also the height and length of the golf club head.

FIGS. 9 and 10 illustrate the axes of inertia through the center of gravity of the golf club head. The axes of inertia are designated X, Y and Z. The X axis extends from the striking plate insert 55 through the center of gravity, CG, and to the rear of the golf club head 40. The Y axis extends from the toe end 68 of the golf club head 40 through the center of gravity, CG, and to the heel end 66 of the golf club head 40. The Z axis extends from the crown section 62 through the center of gravity, CG, and to the sole section 76.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair*.

The center of gravity and the moment of inertia of a golf club head 40 are preferably measured using a test frame ($X^T$, $Y^T$, $Z^T$), and then transformed to a head frame ($X^H$, $Y^H$, $Z^H$) The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

In general, the moment of inertia, Izz, about the Z axis for the golf club head 40 preferably ranges from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$. The moment of inertia, Iyy, about the Y axis for the golf club head 40 preferably ranges from 1500 g-cm$^2$ to 4000 g-cm$^2$, preferably from 2000 g-cm$^2$ to 3500 g-cm$^2$, and most preferably from 2400 g-cm$^2$ to 2900 g-cm$^2$. The moment of inertia, Ixx, about the X axis for the golf club head 40 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

In general, the golf club head 40 has products of inertia such as disclosed in U.S. Pat. No. 6,425,832, and is hereby incorporated by reference in its entirety. Preferably, each of the products of inertia, Ixy, Ixz and Iyz, of the golf club head 40 have an absolute value less than 100 grams-centimeter squared. Alternatively, the golf club head 40 has a at least one or two products of inertia, Ixy, Ixz and Iyz, with an absolute value less than 100 grams-centimeter squared.

As shown in FIGS. 9 and 10, the width, W, preferably ranges from 4.0 inches to 5.5 inches, and most preferably from 4.75 inches to 5.0 inches. The height, H, preferably ranges from 2.0 inches to 3.0 inches, and most preferably ranges from 2.40 inches to 2.65 inches. The length, L, preferably ranges from 3.5 inches to 4.5 inches, and most preferably from 4.0 inches to 4.25 inches. The golf club head 40 may have an aspect ratio such as disclosed in U.S. Pat. No. 6,338,683 for a Striking Plate For A Golf Club Head, assigned to Callaway Golf Company, and which pertinent parts are hereby incorporated by reference.

Those skilled in the pertinent art will recognize that other types of golf club heads can be utilized with the present invention, such as cast body two piece golf club heads with a body and attachable striking plate, sole or crown, a multiple-piece construction golf club heads composed of four or more pieces.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a major body composed of a metal material, the major body having a front wall section, a return section, a sole section, a ribbon section and a ledge section, the front wall section having an opening, the major body having a mass ranging from 140 grams to 200 grams;

a striking plate insert positioned in the opening of the front wall section of the major body, the striking plate insert having a thickness in the range of 0.010 inch to 0.250 inch;

a minor body having a crown section and a ribbon section, the minor body attached to the ledge section of the major body, the minor body having a mass ranging from 4 grams to 50 grams;

wherein the major body and the minor body each has a plurality of interior recesses; said plurality of recesses being uniformly dispersed over substantially the entire interior surface of each of the major body and the minor body.

2. The golf club head according to claim 1 wherein each of said plurality of interior recesses has a diameter ranging from 0.030 inch to 10 microns.

3. The golf club head according to claim 1 wherein each of said plurality of interior recesses has a depth of 50% to 90% of the thickness of the major body and the minor body.

4. The golf club head according to claim 1 wherein a moment of inertia about the Izz axis through the center of gravity of the golf club head ranges from 2800 grams-centimeters squared to 5000 grams-centimeters squared.

* * * * *